US005333325A

United States Patent [19]

Levien et al.

[11] Patent Number: 5,333,325

[45] Date of Patent: Aug. 2, 1994

[54] BATHTUB APRON SYSTEM

[75] Inventors: Robin H. Levien, London, United Kingdom; Adam R. Schmidt, Leonardo, N.J.

[73] Assignee: American Standard Inc., New York, N.Y.

[21] Appl. No.: 90,164

[22] PCT Filed: Jul. 10, 1991

[86] PCT No.: PCT/US91/04816

§ 371 Date: Jul. 15, 1993

§ 102(e) Date: Jul. 15, 1993

[30] Foreign Application Priority Data

Jan. 17, 1991 [GB] United Kingdom ..... 9101034

[51] Int. Cl.[5] ..... A47K 3/02; A47K 3/16

[52] U.S. Cl. ..... 4/584; 4/592; 4/593; 4/546

[58] Field of Search ..... 4/584, 592, 593, 594, 4/595, 538, 546, 901; 312/228, 228.1; 52/34, 35; D23/277, 278, 279, 280, 281

[56] References Cited

U.S. PATENT DOCUMENTS

| | | | |
|---|---|---|---|
| D. 333,515 | 2/1993 | Levien | D23/277 |
| 2,122,247 | 6/1938 | Coordes | 4/495 |
| 2,269,748 | 1/1942 | Widman | 4/584 |
| 2,546,478 | 3/1951 | Sims | 4/901 |
| 4,160,295 | 7/1979 | Putyra | 4/901 |
| 5,230,108 | 7/1993 | Perantoni et al. | 4/584 |

FOREIGN PATENT DOCUMENTS

| | | | |
|---|---|---|---|
| 0281957 | 9/1988 | European Pat. Off. | 4/594 |
| 88017370 | 5/1988 | Fed. Rep. of Germany . | |
| 3901036 | 12/1989 | Fed. Rep. of Germany | 4/592 |
| 2035794 | 6/1980 | United Kingdom . | |

*Primary Examiner*—Henry J. Recla
*Assistant Examiner*—Gregory Vidovich
*Attorney, Agent, or Firm*—Elaine Brenner Robinson; Ann M. Knab

[57] ABSTRACT

A bathtub apron system for use with either one of two differently shaped bathtubs. The bathtub apron system includes an apron having an essentially planar central section with first and second ends, and inwardly rounded sections extending respectively from the first and second ends of the central section. Outwardly rounded sections extend from the ends of the inwardly rounded sections to form the opposing outer edges of the apron. The outwardly rounded sections are removable at a predetermined position from the inwardly rounded sections to form a second shaped apron sized to fit a second shaped bathtub.

8 Claims, 4 Drawing Sheets

16
54
16a
12
40
202
200
60

BATHTUB APRON SYSTEM

BACKGROUND OF THE INVENTION

The present invention is directed generally to a bathtub apron system and, in particular, to a modular bathtub apron which is pre-formed in a first shape to fit a first bathtub configuration, and which can then be conveniently cut to form a differently shaped apron adapted to fit a second bathtub configuration.

Bathtubs, including whirlpool tubs, sauna tubs and the like, come in various shapes and sizes. In addition, such tubs are variously configured to be installed in the corner of a room, against one wall, or free-standing and spaced from the wall. Conventional tubs are pre-formed or cast in the desired shape from various materials including enamel-coated cast iron or steel, plastics, or other materials which can provide a rigid tub structure.

Tubs come either pre-formed with a skirt or apron surrounding the tub to provide a finished appearance thereto, or are formed without such skirt or apron, which is added after the tub has been installed at the Job site. The present invention is directed to tubs which are originally manufactured without a skirt or apron in place, where the skirt or apron will be installed after installation of the tub in the desired location.

In such tubs manufactured without skirts or aprons, the prior art has required that each shaped tub be provided with its own specifically shaped apron to correspond to the shape of the particular tub with which it will be used. Thus, each time a new tub design was developed, a specially designed apron was also required to be designed for use therewith. For example, heretofore, a specially designed corner tub required its own shaped apron, and a conventional oval-shaped tub, either freestanding or against a wall, required a second, newly formed apron.

Accordingly, it is desired to provide a bathtub apron system whereby a single, pre-formed apron is adapted to fit at least two differently shaped bathtubs.

SUMMARY OF THE INVENTION

Generally speaking, in accordance with the present invention, a bathtub apron system for use with either one of two differently shaped bathtubs, is provided. The bathtub apron system includes an apron having an essentially planar central section with first and second ends, and inwardly rounded sections extending respectively from the first and second ends of the central section. Outwardly rounded sections extend from the ends of the inwardly rounded sections to form the opposing outer edges of the apron. The outwardly rounded sections are removable at a predetermined position from the inwardly rounded sections to form a second shaped apron sized to fit a second shaped bathtub.

Accordingly, it is an object of the present invention to provide a bathtub apron system.

Another object of the present invention is to provide a bathtub apron system wherein a single pre-formed bathtub apron can be used to fit at least two differently shaped tubs.

A further object of the present invention is to provide a bathtub apron system which reduces the cost and amount of materials required during manufacture and installation of bathtubs.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a better understanding of the invention, reference is had to the following description taken in connection with the accompanying drawings, in which.

DETAILED DESCRIPTION OF THE PREFERRED EMBODIMENT

Figure 1:
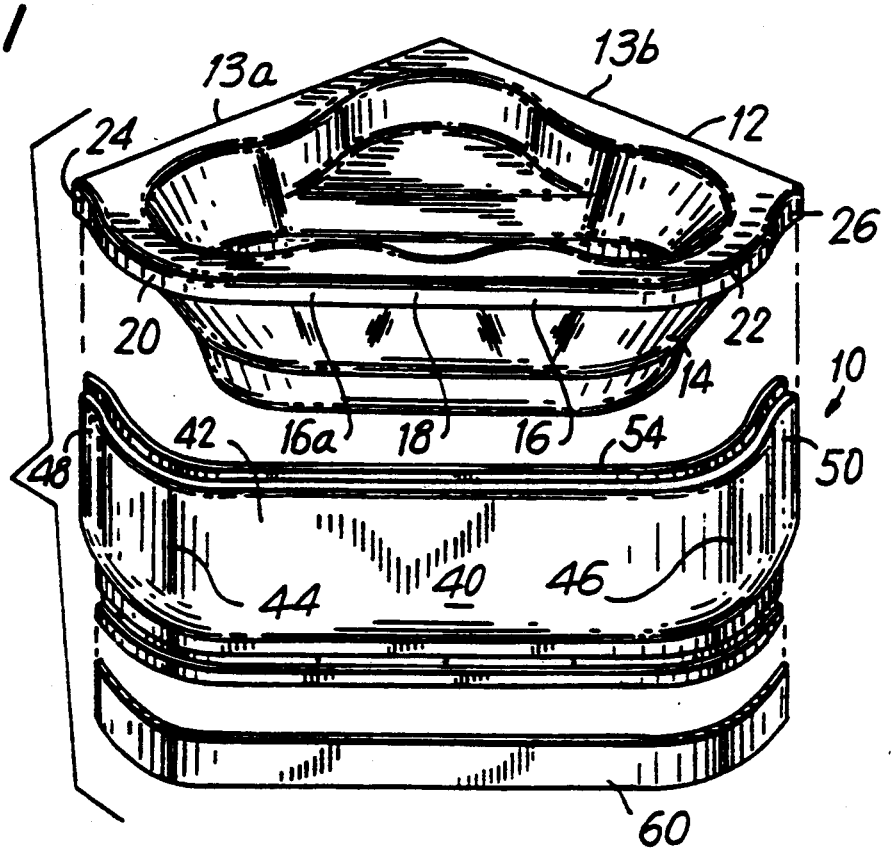
FIG. 1 is an exploded perspective view of a bathtub apron system and bathtub constructed in accordance with the present invention.
Figure 2:
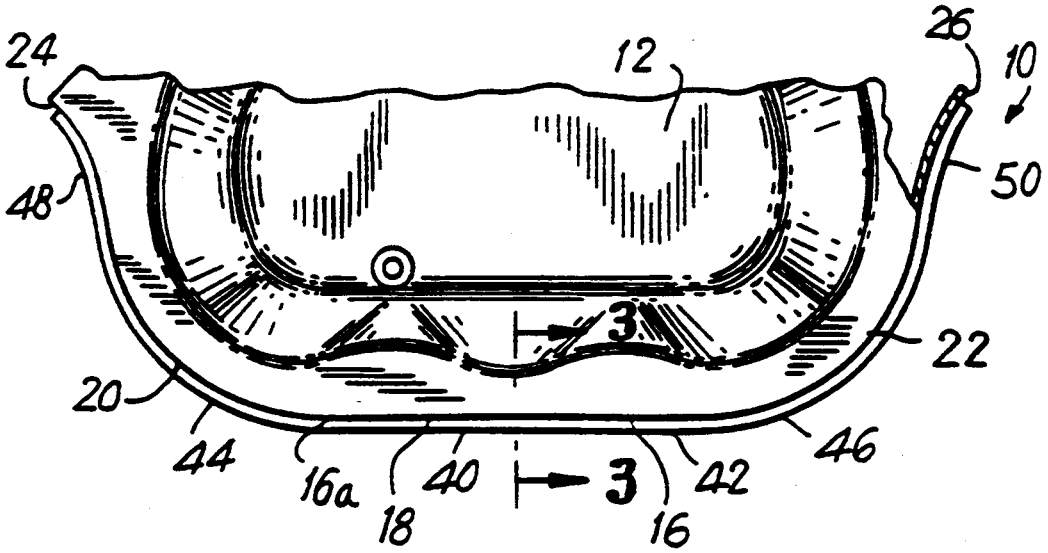
FIG. 2 is a partial top plan view of the bathtub and apron system depicted in FIG. 1.
Figure 3:
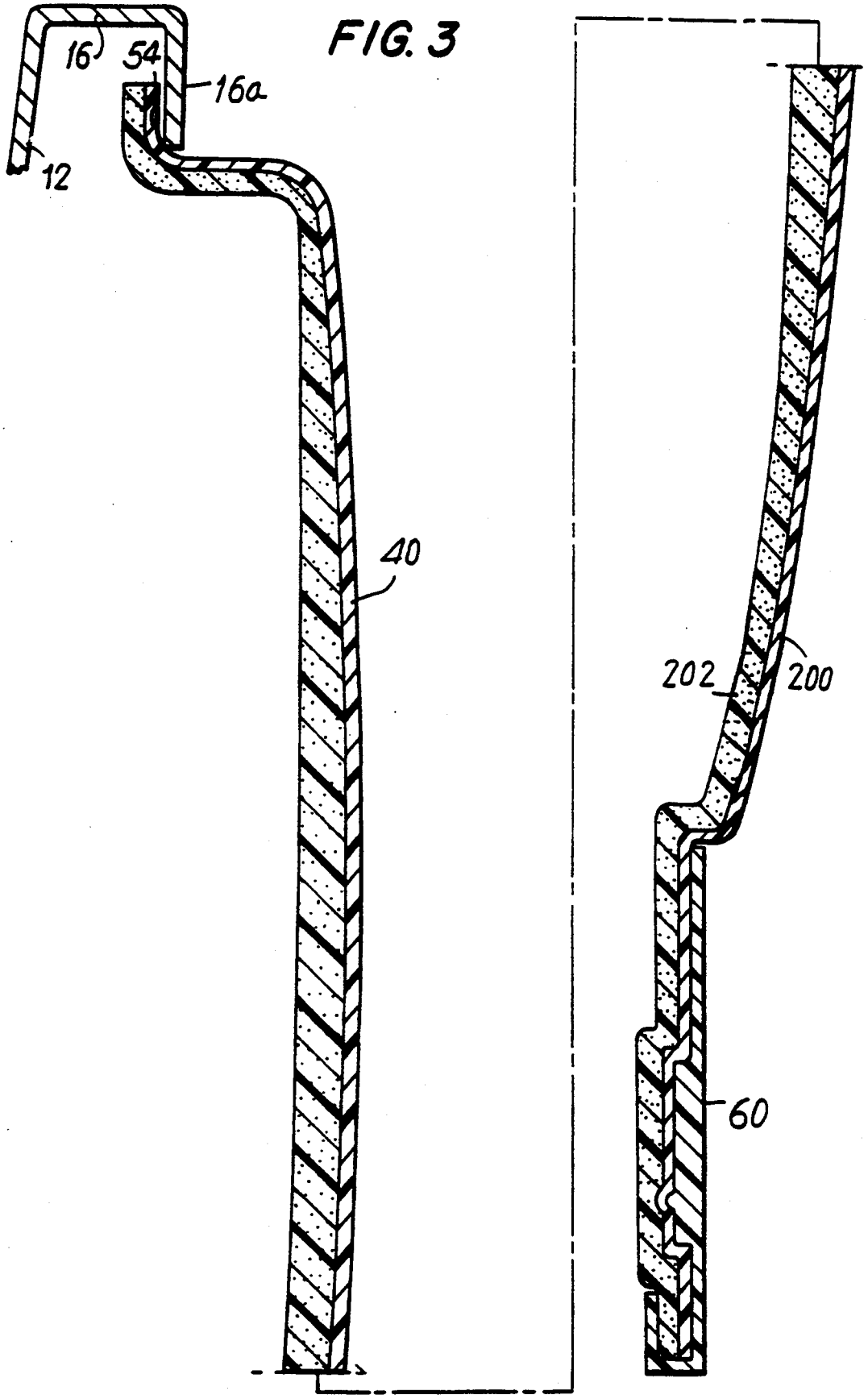
FIG. 3 is an enlarged sectional view taken along line 3—3 of FIG. 2.

Reference is first made to FIGS. 1 through 3 of the drawings which depict a bathtub apron system, generally indicated at 10, constructed in accordance with the present invention. Bathtub apron system 10 is shown in use in conjunction with a first shaped tub 12. Tub 12 is designed as a corner tub having essentially perpendicular side walls 13*a* and 13*b* adapted for installation in the corner of a room. When installed in such a corner, the front unfinished surface 14 of tub 12 will be exposed.

Front rim 16 of tub 12 includes a central portion 18 which is essentially flat or planar and has inwardly rounded portions 20 and 22 extending therefrom. Each of inwardly rounded portions 20 and 22 extend respectively into outwardly rounded portions 24 and 26. Tub 12 may be formed from any suitable material used to form bathtubs, whirlpool tubs or the like such as fiberglass-reinforced acrylic, plastic, enamel-coated steel or cast iron, or other such materials.

In order to cover the exposed front 14 of tub 12, bathtub apron system 10 includes an apron 40 which is generally shaped like rim 16 of tub 12. Apron 40 includes a central section 42 which is essentially planar. Central section 42 terminates in opposing ends 44 and 46 which are rounded inwardly similar to inwardly rounded sections 20 and 22 of rim 16 of tub 12. Inwardly rounded portions 44 and 46 extend outwardly into respective outwardly curved portions 48 and 50 which correspond in essence to the shape of outwardly curved portions 24 and 26 of rim 16.

It is preferred that apron 40 be formed as a thermoformed acrylic sheet 200 which can be reinforced with a fiberglass material 202 as best depicted in FIG. 3. The material may be PVC or the like.

After tub 12 is installed in the desired location at the job site, pre-formed apron 40 is inserted and installed. Apron 40 includes an upper lip 54 which is captured under downwardly extending tongue 16*a* of rim 16 as best depicted in FIG. 3. A kick plate or strip 60 which attaches to the bottom of apron 40 is provided for completing the installation. Pressure sensitive attaching means such as Velcro® may be used to releasably couple strip 60 to apron 40.

Figure 4:
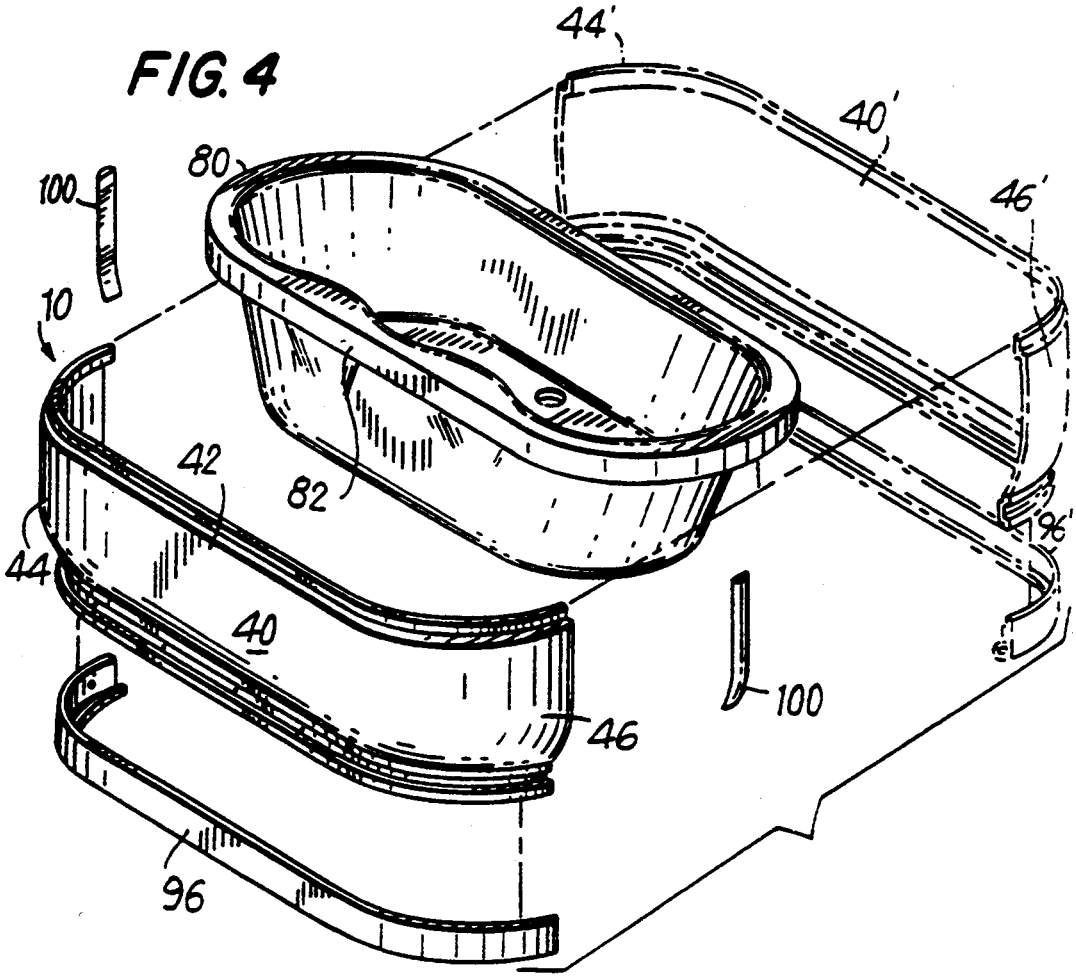
FIG. 4 is an exploded perspective view of the bathtub apron system of the present invention shown in use on a second shaped bathtub.
Figure 5:
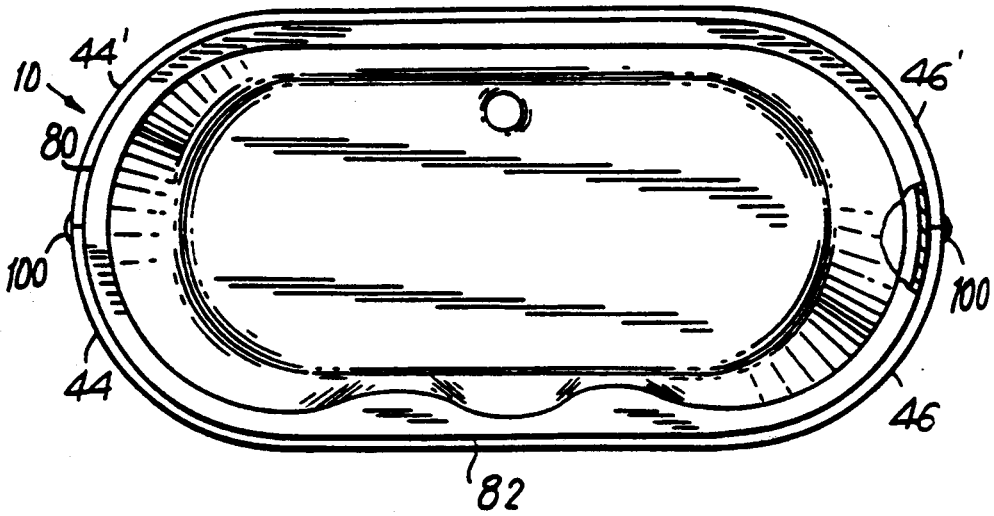
FIG. 5 is a top plan view of the bathtub depicted in FIG. 4.
Figure 6:
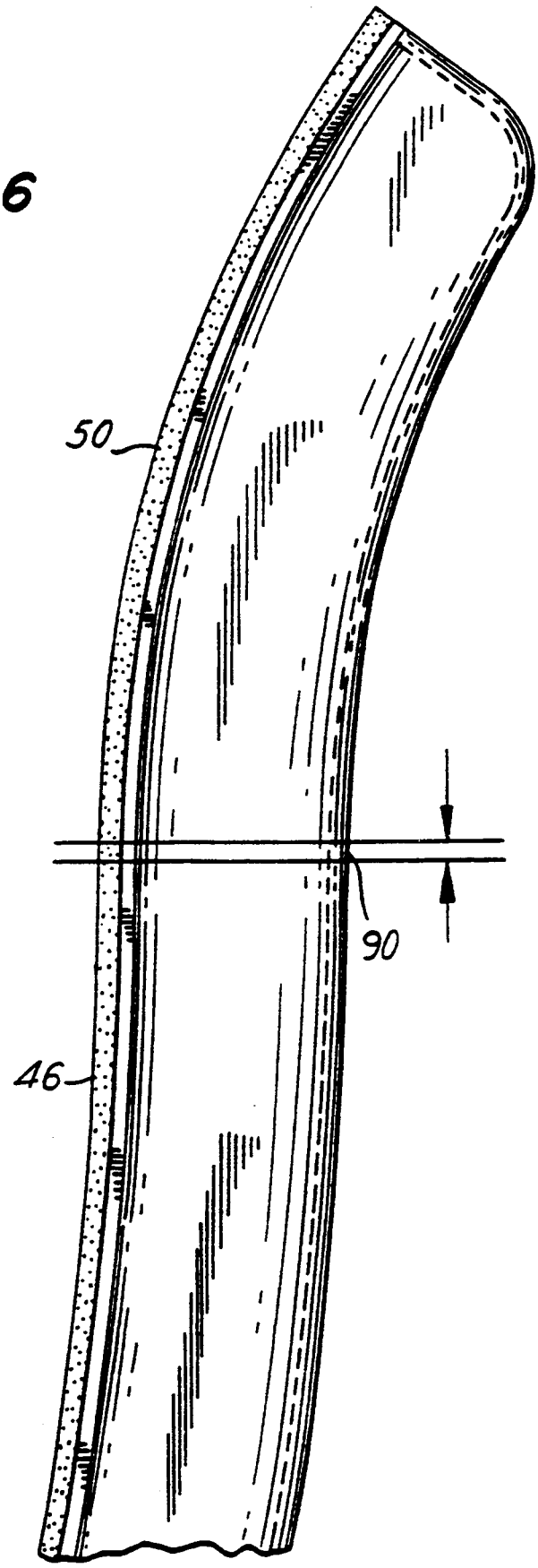
FIG. 6 is an enlarged sectional view of the apron depicted in FIG. 1 showing where the apron can be cut to form a second shaped apron.

Reference is now made to FIGS. 4 and 5 which depict a differently shaped bathtub 80 which in its outward shape is oval in appearance. Apron 40 as depicted in FIG. i will not fit on tub 80 due to outwardly rounded sections 48 and 50 thereof. However, the present inventors have discovered that if outwardly rounded sections 48 and 50 were removed by cutting or like process, the remaining apron would fit on oval tub 80. Hence, FIG. 4 depicts apron system 10 with outwardly curved portions 48 and 50 removed. As seen in FIG. 5, modified apron 40 readily fits under lip 82 of tub 40 and provides a complete finished appearance thereto.

Through the thermoforming process, the tool used will leave a convenient tool line or mark which can be used as a guide for cutting off outwardly curved portions 48 and 50. A saw or similar cutting implement will readily sever the apron sections to be removed.

When tub 80 is installed against a wall, only one modified apron 40 is required. A kick strip 96 provides the finishing appearance. However, when tub 80 is to be installed as a stand alone unit, a second apron 40' can be used as depicted to provide a full finished and closed appearance therearound. When first and second modified aprons 40 and 40' are utilized, a second kick strip 96' is required. Also, flexible trim strips 100 are used to conceal the opposing seams created by the mating of inwardly rounded edges 46 and 46' and 44 and 44'.

Accordingly, the present invention provides a bathtub apron system wherein only one apron is required to be pre-formed for two differently shaped bathtubs. The ends of the apron can be conveniently cut and removed at the tool line to provide a modified apron adapted to fit a second shaped tub. Tool costs are reduced resulting in reduced manufacturing costs.

It will thus be seen that the objects set forth above among those made apparent form the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features the invention herein described and all statements of the scope of the invention which, as a matter of language, might be said to fall therebetween.

What is claimed is:

1. A bathtub apron system for use with either one of two differently shaped bathtubs, comprising an apron having an essentially planar central section with first and second ends, concave rounded sections each having a first end and an opposite second end, said first end of said convex rounded sections extending from and connected to said first and second ends of said central section and concave rounded sections each having a first end connected to and extending from said second ends of said concave rounded sections respectively, said apron being adapted to fit one of said differently shaped bathtubs wherein said one of said differently shaped bathtubs has an outer periphery identical to the shape of said apron with said central, convex and concave sections, said concave rounded sections of said apron being removable at said first ends thereof from said second ends of said concave rounded sections to form a second shaped apron adapted to fit the other of said differently shaped bathtubs wherein said other of said differently shaped bathtubs has an outer periphery identical to the shape of said second apron with said central and convex sections.

2. The bathtub apron system as claimed in claim 1, wherein said second ends of said concave rounded sections are marked with marks to identify a location where said concave rounded sections should be removed.

3. The bathtub apron system as claimed in claim 1, wherein said apron includes an unfurnished bottom, and further comprising a kick plate and coupling means for coupling said kick plate to said apron.

4. The bathtub apron system as claimed in claim 1, wherein one of said two differently shaped tubs is a corner tub and the other of said tubs is an oval tub.

5. The bathtub apron system as claimed in claim 2, wherein said marks are made by a tool used to form said apron.

6. The bathtub apron system as claimed in claim 1, wherein said apron is formed as a thermoformed acrylic sheet.

7. The bathtub apron system as claimed in claim 6, wherein said acrylic sheet is reinforced with a fiberglass material.

8. The bathtub apron system as claimed in claim 1, wherein said second shaped apron forms essentially half of an oval, said second shaped apron, when joined to a like second shaped apron, forms a full oval apron adapted to surround an oval tub.

* * * * *